United States Patent [19]

Willer

[11] Patent Number: 4,869,563

[45] Date of Patent: Sep. 26, 1989

[54] SINGLE PIECE CONSTRUCTION FILE HANGER

[75] Inventor: Allan Willer, Forest, Canada

[73] Assignee: Commander Business Furniture Inc., Agincourt, Canada

[21] Appl. No.: 267,268

[22] Filed: Nov. 4, 1988

[51] Int. Cl.[4] ..... A47B 63/00

[52] U.S. Cl. ..... 312/184; 312/330.1; 211/46

[58] Field of Search ..... 312/184, 185, 330 R; 211/46, 162; 248/224.4

[56] References Cited

U.S. PATENT DOCUMENTS

| | | | |
|---|---|---|---|
| 2,062,802 | 12/1936 | Walker | 211/44 |
| 3,283,912 | 11/1966 | Cullen | 211/46 |
| 3,627,141 | 12/1971 | Kurland et al. | 211/44 |
| 3,730,738 | 5/1973 | Cook et al. | 312/184 |
| 3,944,080 | 3/1976 | Hansen | 312/184 |
| 3,999,663 | 12/1976 | Walter et al. | 312/184 |
| 4,219,247 | 8/1980 | Litchfield et al. | 312/184 |

FOREIGN PATENT DOCUMENTS

| | | | |
|---|---|---|---|
| 791837 | 3/1958 | United Kingdom | 312/184 |

*Primary Examiner*—Kenneth J. Dorner
*Assistant Examiner*—Brian K. Green

[57] ABSTRACT

A frame member usable with a like frame member supports file folders in a cabinet drawer. The frame member has a solid one piece construction consisting of an elongated file receiving rail and a pair of outer end support legs on the rail. The support legs are flexible longitudinally of the rail and have free ends which are shaped for locking into recesses provided in the drawer by flexing the legs.

2 Claims, 2 Drawing Sheets

2
21
23
3

17a
19a
6

17
6
19

15
17
H
13
F 13
9
15
21

15
17
5
6
11
13
3
9
21
7
2

SINGLE PIECE CONSTRUCTION FILE HANGER

FIELD OF THE INVENTION

The present invention relates to a drawer mounted hanging file frame.

BACKGROUND OF THE INVENTION

There are many different types of in-drawer frames for receiving hanging files. Substantially all of the frames which are presently available have a multi-piece construction and require adjustment means within the frame or actually cutting of the frame to fit the different drawer lengths. Furthermore, the frames that are presently available require a substantial supporting structure both lengthwise and widthwise of the frame to be self-supporting within the file drawer. This requires not only a relatively high number of frame parts but also often substantial set up time on behalf of the person putting the frame together.

SUMMARY OF THE PRESENT INVENTION

The present invention relates to a frame member usable with a like frame member to hang file folders. The frame member is unique yet extremely simple in its construction and in combination with its like frame member requires almost no time or mechanical skills for set up.

More particularly, the frame member of the present invention is fittable directly to a cabinet drawer having a slider as is standard and drawer recesses at each end of the slider. The frame member itself has a solid one piece construction consisting of an elongated file receiving rail and a pair of outer end support legs on the rail. The support legs are flexible longitudinally of the rail and have free ends which are shaped for locking into the drawer recesses simply by flexing the legs.

No cutting or assembly for individual parts is required to set the frame up and because of the relatively low cost of the one piece construction it is feasible to build frames of different lengths for different drawer sizes.

BRIEF DESCRIPTION OF THE DRAWINGS

The above as well as other advantages and features of the present invention will be described in greater detail according to the preferred embodiments of the present invention in which.

DETAILED DESCRIPTION ACCORDING TO THE PREFERRED EMBODIMENTS OF THE PRESENT INVENTION

Figure 1:
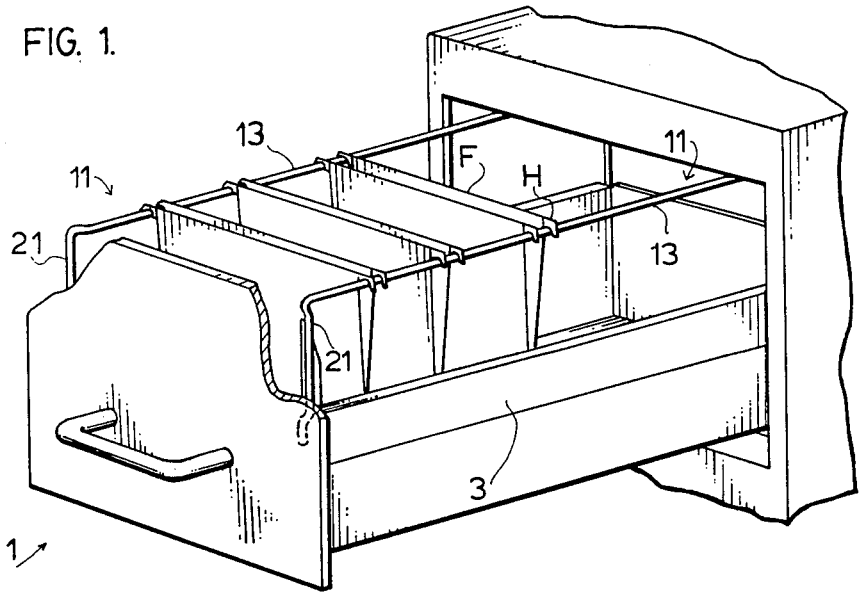
FIG. 1 is a perspective view of a drawer fitted with a pair of frame members each of which is made according to a preferred embodiment of the present invention.
Figure 2:
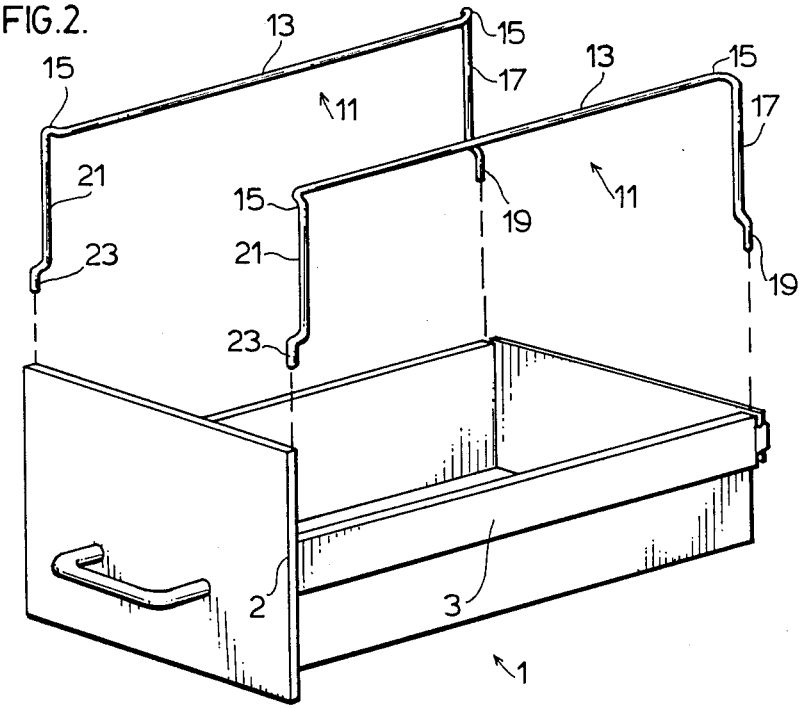
FIG. 2 is a further perspective view of the drawer of FIG. 1 as it is being fitted with the frame members.

FIG. 1 shows an open drawer generally indicated at 1 and which is slideable between an open and a closed position by means of a pair of drawer sliders 3 only one of which can be seen in FIG. 1. Supported within the drawer are a pair of frame members generally indicated at 11.

The frame members 11 are quickly and easily fitted into the drawer and use the drawer structure itself as support for hanging a plurality of files F each of which is provided with its own hanger H hung to either side of the drawer by the frame members as shown in FIG. 1.

The above construction is to be compared to prior art file hangers which comprise their own supporting structure and simply sit within the confines of the filing cabinet. Furthermore, according to the present invention and unlike prior art constructions, there are no cross members required between the two frame members.

The frame members of the present invention are designed to fit to a relatively standard drawer construction and in particular to the standard drawer of a file cabinet made by Commander Business Furniture of Toronto, Ontario, Canada, the 1800, 2400 and 2600 series. This particular drawer includes a open or cut out area generally indicated at 5 to the rear of slider 3 and a drawer opening generally indicated at 7 at the front end of the slider. The rear opening 5 is bordered by the slider 3 and drawer section 6 while the forward opening 7 is bordered by slider 3 and the front door 2 of the drawer. The interfitting of the frame member relative to these drawer portions will be described later in detail. However, a full description of the frame member itself is as follows.

Figures 3, 4, 5, 6, 6A, 7:
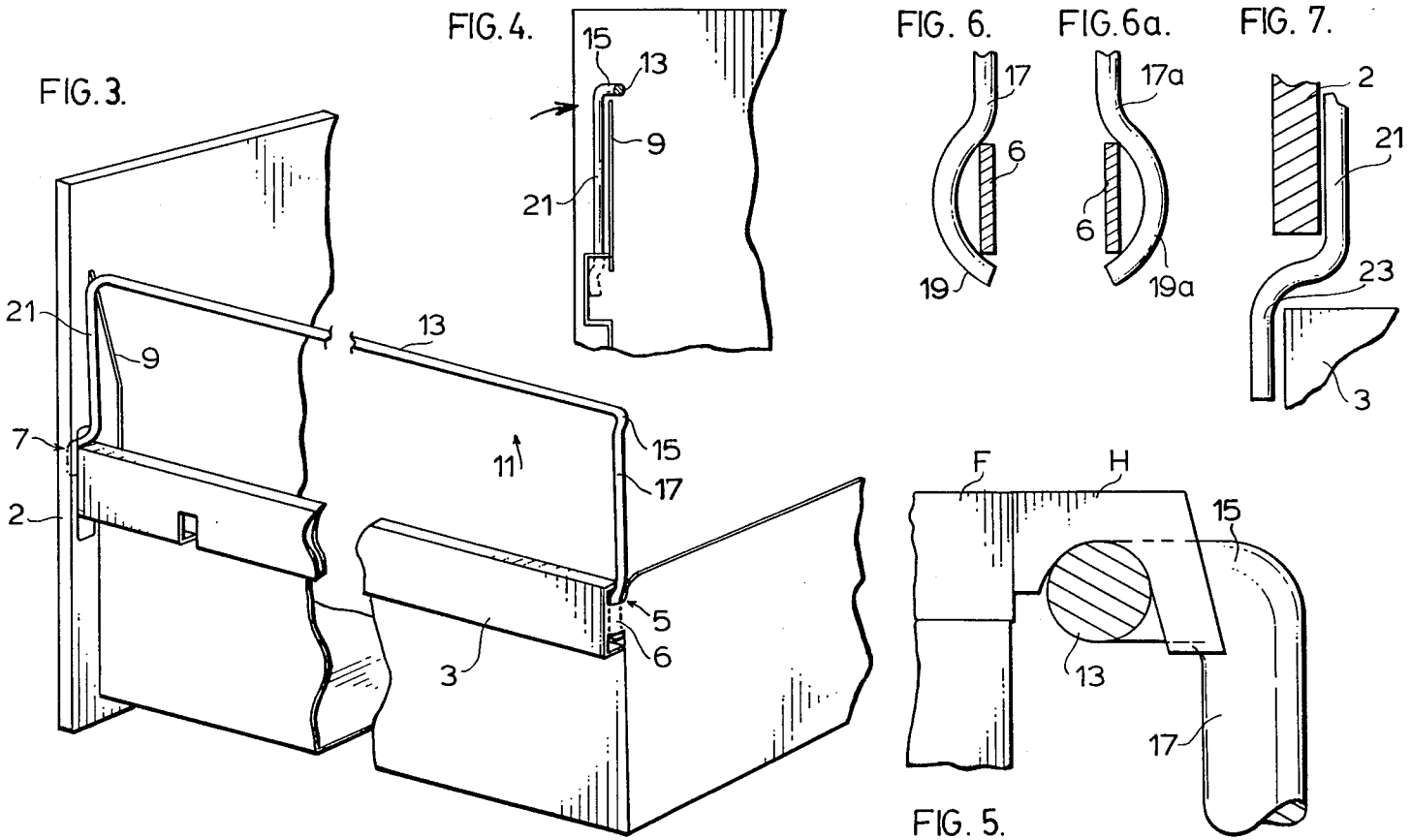
FIG. 3 is a side perspective view of the drawer of FIGS. 1 and 2 fitted with one of the frame members.
FIG. 4 is a rear view of the drawer of FIG. 3.
FIG. 5 is an enlarged sectional view along the rail from the frame member of FIG. 3.
FIG. 6 is an enlarged sectional view at the rear of the drawer of FIG. 3 and showing the lower end of the supporting leg of the frame member according to a preferred embodiment of the present invention.
FIG. 6*a* is a view similar to FIG. 6 but showing a different preferred embodiment of the present invention.
FIG. 7 is an enlarged sectional view showing the fitting of the forward lower end of the supporting leg in the drawer.

Each of the frame members 11 has a unitary construction preferably made from a spring steel or spring steel-like material. This unitary construction comprises an elongated rail portion 13 which extends over the complete length of the drawer and which is provided at its opposite ends with a pair of supporting legs 17 and 21. The rail portion extends into the supporting legs at bent regions 15 of the frame member which provide a lateral by inward offset between the rail member and its supporting legs. This feature is best shown in FIG. 5 of the drawings where it can be clearly seen that rail portion 13 is set laterally inwardly relative to its supporting leg 17. Again, the purpose for this feature will be described later in detail.

Supporting leg 17 is provided with a curved lower end or foot 19 while supporting leg 21 is provided with a curved lower end or foot 23. The specific curvatures at the lower ends 19 and 23 are shown in FIGS. 6 and 7 of the drawings.

A further feature of the drawer member itself is the provision of upright flange 9 which is a standard feature not only on the Commander drawer but also on most other drawer designs. Although the specific opening designs indicated at 5 and 7 of the Commander drawer may not be found in other drawers, these other drawers can easily be modified to provide these or similar drawer openings for fitting of the frame member as described immediately below.

As a result of the frame member unitary construction made from spring steel or spring steel-like material it has an overall flexibility and in particular supporting legs 17 and 21 are flexible longitudinally of the frame member. It is this longitudinal flexibility that provides for the tight or secure support of the frame member which is first fitted into position by locating the front foot 23 at the lower end of supporting leg 21 into opening 7 at the front end of the drawer slider 3 as shown in FIG. 7 of the drawings. The natural spread of the front and rear legs is slightly greater than the length of the slider so that the rear leg 17 is then collapsed inwardly to locate foot 19 in opening 5. By then releasing the rear leg 17 it springs outwardly where foot 19 locks up against drawer section 6 as shown in FIG. 6 of the drawings. This spring fitting of the frame member provides a lengthwise locking of the frame member relative to the drawer. The lateral support and in particular lateral inward support for the frame member is provided by upright flange 9 where the front leg 21 of the frame member sits against the flange as shown in FIG. 4 of the drawings. This prevents the frame members to either side of the drawer frame from collapsing inwardly when loaded with files as shown in FIG. 1 of the drawings. There is no need to provide an outward support for the frame members since there is no load placed on them in this direction. In fact, the files themselves when hung on the frame members prevent any outward movement of the frame members as will be clearly seen in FIG. 1.

FIGS. 6 and 7 clearly show how each of the lower ends or feet 19 and 23 are specifically shaped to lock onto the drawer section 6 and the front end of the slider 3. FIG. 6*a* shows a slight modification where the rear leg 17 is replaced by a rear leg 17*a* having a lower end or foot 19*a* of reversed curvature to that shown in FIG. 6. When working with a frame member having a rear leg 17*a* the forward and rearward supporting legs are set at a spacing slightly less than the length of the drawer slider whereby the rear leg must be stretched outwardly and then allowing foot 19*a* to spring back inwardly against drawer section 6 and secure the frame member longitudinally of the drawer. In other words, the frame member can either be spring inwardly and fitted to the inside of drawer section 6 as shown in FIG. 6 or spring outwardly and allowed to snap back inwardly over this same drawer section as shown in FIG. 6*a* of the drawings. In either case, the forward foot 23 will have the same configuration as shown in FIG. 7 to secure the frame member at the front of the drawer.

As noted above, rail portion 13 of the frame member is laterally inset relative to the supporting legs. This feature allows each of the hangers H on the files F to hang outwardly over the rail portion while still being located inwardly of the supporting legs which are set almost out as far as they can be while still allowing drawer closure.

It will now be seen from the description above how a frame member usable with a like frame member and also usable with a relatively standard drawer set up provides a simple yet efficient file hanger. The unitary construction of each of the hanger members further provides a simple yet effective locking action of the frame members into the drawer. Most drawers are again of a standard length to which the frame members are set. However, because of the simple and inexpensive construction of each of the frame members, they can easily be made of different sizes according to different drawer lengths as required.

Although various preferred embodiments of the invention have been described in detail, it will be appreciated that variations may be made without departing from the spirit of the invention or the scope of the appended claims.

The embodiments of the invention in which an exclusive property or privilege is claimed are defined as follows:

1. A filing cabinet drawer fitted with a pair of spaced apart non-connected parallel frame members for hanging file folders from said frame members, said drawer having a front door and pair of drawer sliders attached thereto, with drawer openings in one end of each of said sliders, each of said frame members having a one piece construction comprising an elongated rail portion and a pair of vertical support legs at each end of said rail portion, said rail portion being laterally inset relative to said support legs and said support legs being flexible longitudinally of said frame member and being free ended with curved feet which are flexed and each frame member having one support leg springingly secured in said drawer opening and the other support leg secured in a drawer opening in said front door.

2. A filing cabinet drawer as claimed in claim 1, wherein said drawer includes a pair of upright flanges providing an inward lateral rest for said frame members.

* * * * *